US005081731A

United States Patent [19]

Yamakita et al.

[11] Patent Number: 5,081,731

[45] Date of Patent: Jan. 21, 1992

[54] METHOD OF CONTINUOUS CHANGING DYE-COLOR IN SPRAY DYEING

[75] Inventors: Yoshimichi Yamakita; Mitsugu Umino, both of Toyama, Japan

[73] Assignee: Yoshida Kogyo K. K., Tokyo, Japan

[21] Appl. No.: 522,975

[22] Filed: May 14, 1990

[30] Foreign Application Priority Data

May 18, 1989 [JP] Japan ..... 1-124762

[51] Int. Cl.[5] ..... D06B 1/02; D06B 23/30

[52] U.S. Cl. ..... 8/151; 8/158; 68/205 R; 118/70; 118/302

[58] Field of Search ..... 8/151, 158; 68/205 R, 68/13 R; 118/70, 302

[56] References Cited

U.S. PATENT DOCUMENTS

| | | | |
|---|---|---|---|
| 3,892,109 | 7/1975 | Klein et al. | 68/205 R |
| 3,939,675 | 2/1976 | Klein | 68/205 R |
| 4,375,865 | 3/1983 | Springer | 118/302 X |
| 4,403,736 | 9/1983 | Scharfenberger | 118/302 X |
| 4,790,155 | 12/1988 | Daniel et al. | 68/205 R |
| 4,912,946 | 4/1990 | Keller | 118/70 X |

FOREIGN PATENT DOCUMENTS

| | | | |
|---|---|---|---|
| 0116757 | 8/1984 | European Pat. Off. | 68/205 R |
| 0353963 | 2/1990 | European Pat. Off. . | |
| 2256983 | 8/1975 | France . | |

*Primary Examiner*—Philip R. Coe

*Attorney, Agent, or Firm*—Hill, Van Santen, Steadman & Simpson.

[57] ABSTRACT

A method of continuous changing dye-color in spray dyeing for a long tape, which is fed by guides continuously. According to a preferred embodiment, one dye-solution is sprayed for the tape from at least one dyeing-nozzle connected to one feeding line, which is either of a pair of feeding lines and which feeds selectively the one dye-solution or one cleaning-solution. When the tape is fed with a predetermined length, the spraying of the one dye-solution is stopped. Then, the one dyeing-nozzle is exchanged with at least one other dyeing-nozzle by turning the one dyeing-nozzle away from the tape and turning the other dyeing-nozzle to the tape for spraying another dye-solution. While the other dye-solution is sprayed, the one dyeing-nozzle, which was used for spraying for a proceeding sprayed portion of the tape, and the one feeding line, to which the one dyeing-nozzle is connected, are cleaned with the one cleaning-solution to prepare for spraying a new dye-solution. Further, at just one time when an undyed portion, which is produced by the exchanging of the dyeing-nozzles, passes through each guide, the dye-solution attached to each guide is removed so as not to mix into a following sprayed portion of the tape.

3 Claims, 3 Drawing Sheets

METHOD OF CONTINUOUS CHANGING DYE-COLOR IN SPRAY DYEING

BACKGROUND OF THE INVENTION

1. Field of the Invention

This invention relates to a method of continuous changing dye-color in spray dyeing for a long tape to be dyed such as a slide fastener chain, a slide fastener tape and the like, which is fed continuously, while the dye-color is changed every time the tape is fed and sprayed with a predetermined length selected from many kinds of sizes.

2. Prior Art

As well known, in conventional methods of spray dyeing, a tape to be dyed is sprayed with a dye-solution from one dyeing-nozzle. However, when many kinds and small amounts of products are desired to be produced, dye-colour should be changed at every tape. In this case, an introducing tape, which is used for changing of the dye-color and whose length is equal to the length of a feed path for the tape from the inlet to the outlet in a dyeing apparatus, is connected between a proceeding tape to be dyed and a following tape to be dyed. When the introducing tape comes into the inlet of the feed path on finishing of proceeding dyeing for the proceeding tape, spraying of a dye-solution from the dyeing-nozzle is stopped but feeding of the introducing tape is yet continued until the forward end of the introducing tape comes to the outlet of the feed path. Then, in order to spray another dye-solution for the following tape, following treatments are required;

Firstly, the dyeing-nozzle and a feeding line for the dye-solution to the dyeing-nozzle are cleaned. Secondly, the dye-solution is changed to the other dye-solution. Finally, the guides, which are provided in the dyeing apparatus and by which the tape is fed, are cleaned.

According to the above mentioned prior method by the dyeing apparatus having only one nozzle for the changing of the dye-color, the introducing tapes must be connected previously between the proceeding tape and the following tape, and the feeding of the tape must be stopped once during every cleaning operation. This causes a low efficiency of productivity due to labor for the changing of the dye-color.

SUMMARY OF THE INVENTION

It is therefore an object of the present invention to provide a method of continuous changing dye-color in spray dyeing for a long tape to be dyed, the method permits automatic changing of the dye-color without a connecting member such as an introducing tape and without stop of feeding of the tape.

According to the present invention, at least one or first dyeing-nozzle is connected to one feeding line of a pair of feeding lines, each of which feeds selectively a dye-solution or a cleaning-solution. One dye-solution is sprayed from the one dyeing-nozzle for a long tape, which is to be dyed and which is fed by over guides continuously. When the tape is fed with a predetermined length, spraying with the one dye-solution is stopped. Then, the one dyeing-nozzle is exchanged with one other or second dyeing-nozzle, which is connected to another feeding line feeding another dye-solution, in order to spray the other dye-solution for a following portion of the tape to be sprayed. During this spraying, the one dyeing-nozzle, which was used for the spraying for a proceeding sprayed portion of the tape, and the one feeding line, to which the one dyeing-nozzle is connected, are cleaned to prepare for feeding a new dye-solution. Further, while an undyed portion, which is produced by the exchanging of the dyeing-nozzles and which is provided between the proceeding sprayed portion and the following sprayed portion, passes over or through each guide, the one dye-solution, which is attached to the guides, is removed.

The number of the dyeing-nozzles can be increased as desired in accordance with the width of the tape.

For changing of the dye-color, the at least one or first dyeing-nozzle is exchanged with at least one other dyeing-nozzles, which has been already prepared for the next spraying, thus, the changing of the dye-color can be carried out in short time and the length of the undyed portion can be short. While the other dye-solution is sprayed, the one dyeing-nozzle, which was used for the spraying for the proceeding sprayed portion of the tape, is cleaned to be prepared so as to spray the new dye-solution. Accordingly, one long tape can be separately dyed by many kinds of desired dye-colors. Moreover, the dye-solution, which has been attached to each guide, is removed just on time when the undyed portion of the tape passes through each guide. Therefore, the dye-solution is not mixed into the following sprayed portion due to the cleaned guides. As a result, the long tape can be continuously fed and the changing of the dye-color can be carried easily out.

Further objects and advantages of the present invention will be apparent from the following description, reference being had to the accompanying drawing wherein preferred embodiments of the present invention are clearly shown.

DESCRIPTION OF THE PREFERRED EMBODIMENT

Now, the method of the present invention is described referring to an apparatus for carrying out the method.

Figure 1:
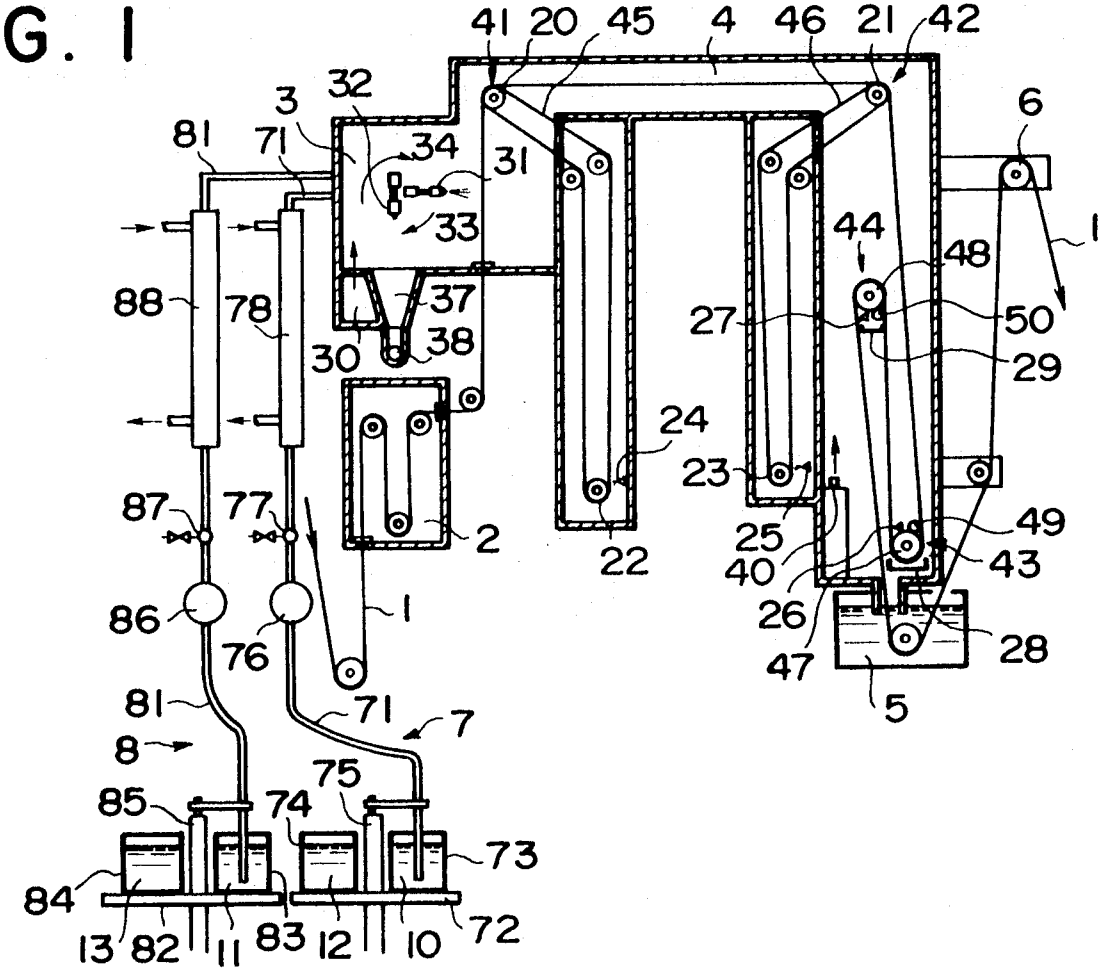
FIG. 1 is a schematic cross sectional view showing an apparatus for carrying out the method of continuous changing dye-colour in spray dyeing.

By an apparatus shown in FIG. 1, a long tape 1 to be dyed, which is made by woven or knitted cationdyeable-polyester-fiber, is sprayed with a dye-solution 10, 11 at the temperature of 100° C. under an atmospheric pressure. The apparatus comprises a predrying chamber 2, a dye-solution spraying chamber 3, a coloring chamber 4 and a water seal bath 5. The colouring chamber 4 is placed to be connected to the dye-solution spraying chamber 3 and bends to be hook-shaped chamber comprising a horizontal portion and a vertical portion. After the tape 1 is fed through the predrying chamber 2, the tape 1 is inserted into the dye-solution spraying chamber 3 from the bottom thereof. Next, the tape 1 is fed through the dye-solution spraying chamber 3 and the coloring chamber 4 by more than two (in this embodiment, four) guides 41, 42, 43, 44 in the chambers 3, 4. Then, the tape 1, which is fed out from the bottom of the coloring chamber 4, is fed through the water seal bath 5. Finally, the tape 1 is taken off by a take-off roll 6.

Dry air of 120° C. is blown into the predrying chamber 2. Steam is introduced into the dye-solution spraying chamber 3 from a steam inlet 30 and into the colouring chamber 4 from a steam inlet 40, so that humid air of 100° C. is kept in the chambers 3, 4.

In the dye-solution spraying chamber 3, the tape 1 is fed upward. A pair of dyeing-nozzles 31, 32 are provided at the side of the fed tape 1 in the dye-solution spraying chamber 3. The dye-solution 10, 11 and a cleaning-solution 12, 13 are sprayed from the dyeing-nozzles 31, 32. The dyeing-nozzles 31, 32 are designed so that one dyeing-nozzle 31, 32 is turned toward the tape 1 while another dyeing-nozzle 32, 31 is turned away from the tape 1 by turns. That is to say, in FIG. 1, the dyeing-nozzle 31 faces the tape 1 and the dyeing-nozzle 32 faces downward, their directions can be changed every time the dye-color is changed.

Figure 2:
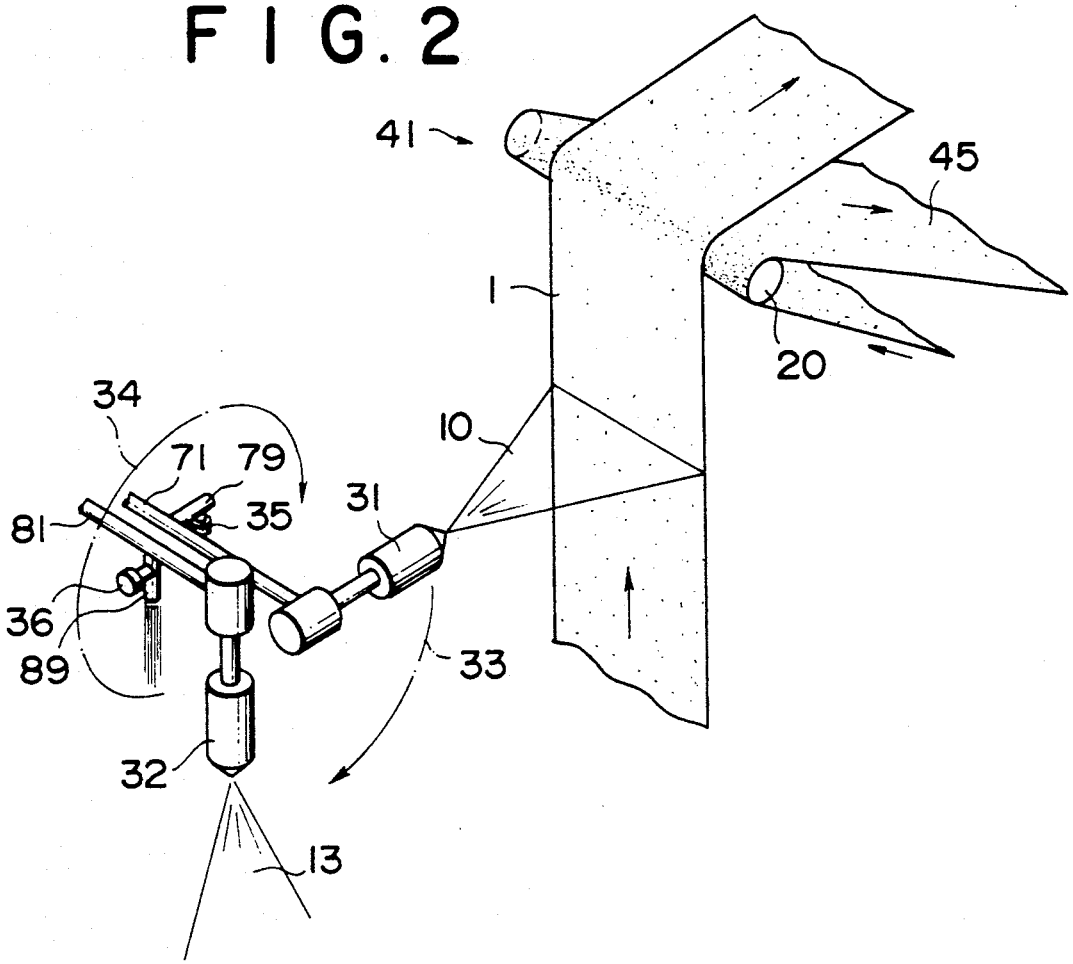
FIG. 2 is a perspective view showing operation of spray dyeing.

Each dyeing-nozzle 31, 32 locates and directs with a relation shown in FIG. 2. The dye-solution 10, 11 is sprayed in the shape of an unfolded fan on a plane from the dyeing-nozzle 31 as shown in FIG. 2. The dyeing-nozzle 31 adjacent the tape 1 swings downward about a pipe 71 through an angle of 90° in the direction of an arrow 33. The other dyeing-nozzle 32, which has directed downward and vertically, swings upward about a pipe 81 through an angle of 270° in the direction of an arrow 34. If the dyeing-nozzles 31, 32 are exchanged with each other, operation of each dyeing-nozzle 31, 32 in FIG. 2 is carried out by the other dyeing-nozzle 32, 31. Although there are two dyeing-nozzles 31, 32 in this figure, the number of the dyeing-nozzles can be increased in accordance with the width of the tape 1. Each pipe 71, 81 is connected to each dyeing-nozzle 31, 32 respectively. Each bypass drain 79, 89 is diverged from each pipe 71, 81, through the intermediary of each solenoid controlled valve 35, 36 respectively.

As shown in FIG. 1, a solution collecting part 37, which is V-shaped on its cross section and which has a drain 38 on its bottom, is provided under the dye-solution spraying chamber 3.

Each dyeing-nozzle 31, 32 is connected to each feeding line 7, 8, which feeds selectively the dye-solution 10, 11, or cleaning-solution 12, 13. Each feeding line 7, 8 forms a spraying assembly, which will be described as follows. The mechanisms of the both spray assemblies are same, thus only one of them is explained. A dye-solution tank 73 and a cleaning-solution tank 74 are placed on a table 72. The pipe 71 is moved upward and downward by a cylinder 75. The cylinder 75 is rotated or the table 72 is rotated. Accordingly, an intake of the pipe 71 can be inserted into and pulled out from the dye-solution tank 73 and the cleaning-solution tank 74 by turns. A pump 76, a regulator 77 and a steam heater 78 are furnished on the pipe 71 one by one. As for the feeding line 8, a table 82, a dye-solution tank 83, a cleaning-solution tank 84, a cylinder 85, a pump 86, a regulator 87 and a steam heater 88 are furnished on the pipe 81 similarly.

Therefore, the dyeing-nozzle 31 faces the tape 1, which is fed continuously, so that the dye-solution 10 is sprayed from the dyeing-nozzle 31 for the tape 1 while the other dyeing-nozzle 32 faces downward toward the drain 38 so that the spraying assembly including the dyeing-nozzle 32 is cleaned with the cleaning-solution 13 fed by the feeding line 8 of the cleaning-solution 13. In this operation, since the bypass drain 89 is provided besides the dyeing-nozzle 32, cleaning is carried out in far shorter time than cleaning without the bypass drain 89 with the cleaning-solution 13, which would flow out from only the dyeing-nozzle 32. That is to say, the great amount of the cleaning-solution 13 flows mainly from the bypass drain 89 in addition to from the dyeing-nozzle 32. Before this cleaning operation is finished, the dye-solution 11, which is different from the dye-solution 10, is prepared to be fed, by means of, for example, rotating the table 82 or rotating the cylinder 85. Then, after cleaning, the intake of the pipe 81 is inserted into the tank 83, which contains the other dye-solution 11, further the bypass drain 89 is closed so that this spraying assembly prepares for feeding the dye-solution 11. When the tape 1 is fed with a predetermined length, feeding of the dye-solution 10 is stopped. In order to change the dye-color, the dyeing-nozzle 31, which has finished spraying for the proceeding sprayed portion of the tape 1, is turned away from the tape 1, while the other dyeing-nozzle 32, which has finished being cleaned with the cleaning-solution 13, is turned toward the tape 1 to spray the dye-solution 11.

During changing operation of the dye-color, the tape 1 continues to be fed by the guides 41, 42, 43, 44 in the colouring chamber 4. The guides 41, 42, 43, 44 should be cleaned after every changing of the dye-color, because, if the guides 41, 42, 43, 44 are not cleaned, the dye-solution 10, 11 which is attached to each guide 41, 42, 43, 44 would be mixed into a following sprayed portion with the other dye-solution 11, 10. In this embodiment, there are different means for cleaning the guides 41, 42, 43, 44; a first means carried out in the first half of this cleaning operation for the guides 41, 42 and a second means carried out in the second half of this cleaning operation for the guides 43, 44.

As shown in FIG. 1, the first means for cleaning the guides 41, 42 comprises two same mechanisms; one mechanism for cleaning the guide 41, another mechanism for cleaning the guide 42. In the one mechanism, the guide 41 is provided with a primary roll 20 placed in the colouring chamber 4, a vice-roll 22 placed outside of the coloring chamber 4, and an endless belt-shaped liner 45. The liner 45 is put over between the primary roll 20 and the vice-roll 22. The primary roll 20 lets the tape 1 change its direction at right angle. A rotating force is transformed to either the primary roll 20 or the vice-roll 22. A cleaning-nozzle 24 faces the liner 45 which is put over the vice-roll 22 at the lower part of its periphery. When the spraying operation is carried out, the liner 45 is at rest. An undyed portion is produced, between a proceeding sprayed portion and the following sprayed portion, by exchanging of the dyeing-nozzles 31, 32 with each other so as to face the tape 1 at different turns. Just on time when the undyed portion passes through the guide 41, the liner 45 is rotated with an angle of 180° so that a clean portion of the liner 45 covers the primary roll 20 while each dye-solution 10, 11, which is attached to the liner 45, is removed with each cleaning-solution 13, 12 from the cleaning-nozzle 24. Cleaning operation using this mechanism can be carried out by not only above mentioned operation but also following operation;

The liner 45 keeps rotating during spray dyeing. Before changing the dye-color, the liner 45 is cleaned with the cleaning-solution 13, 12 from the cleaning-nozzle 24 for a predetermined time. Then, the changing of the dye-color is carried out.

The other mechanism containing a primary roll 21, a vice-roll 23, a liner 46, and a cleaning-nozzle 25 is operated similarly to the above mentioned mechanism.

Figure 3:
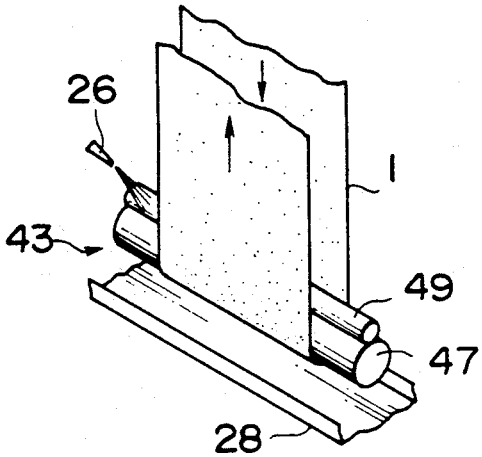
FIG. 3 is a perspective view showing operation of cleaning for a lower guide.
Figure 4:
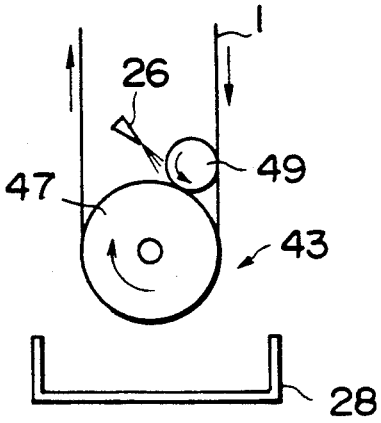
FIG. 4 is a side view thereof.
Figure 5:
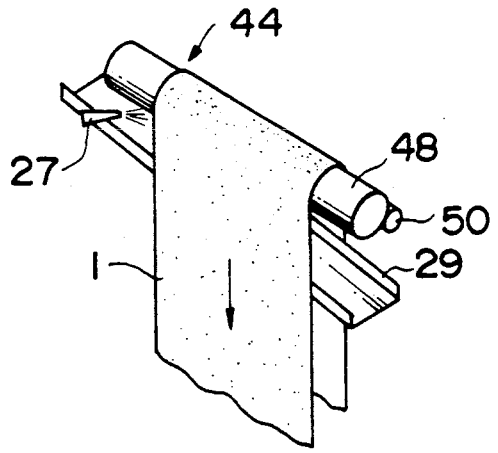
FIG. 5 is a perspective view showing operation of cleaning for an upper guide.

As shown in FIGS. 3, 4 and 5, the second means for cleaning the guides 43, 44, by which the tape 1 is fed downward and forward in a zigzag line in the vertical portion of the coloring chamber 4, comprises an upper mechanism and a lower mechanism. The tape 1 is put over a roll 47 at the lower part of its periphery in the lower mechanism and is put over a roll 48 at the upper part of its periphery in the upper mechanism. In the low mechanism, the roll 47 itself serves as the guide 43. A drain roll 49 is placed in pressure to be contacted with the roll 47. A cleaning-nozzle 26 is placed so as to spray each cleaning-solution 12, 13 for the rolls 47, 49. A receiving gutter 28 is placed under the tape 1 which puts over the roll 47 at the lower part of its periphery. The upper mechanism has same composition with the composition of the lower mechanism except that a receiving gutter 29 is placed under a cleaning-nozzle 27 and a drain roll 50, which is placed in pressure to be contacted with a roll 48. Then, just on time when the undyed portion of the tape 1 passes through the guide 43, 44, each cleaning-solution 13, 12 is sprayed for the rolls 47, 48, 49, 50 for removing each dye-solution 10, 11 attached to each roll 47, 48.

Figure 6:
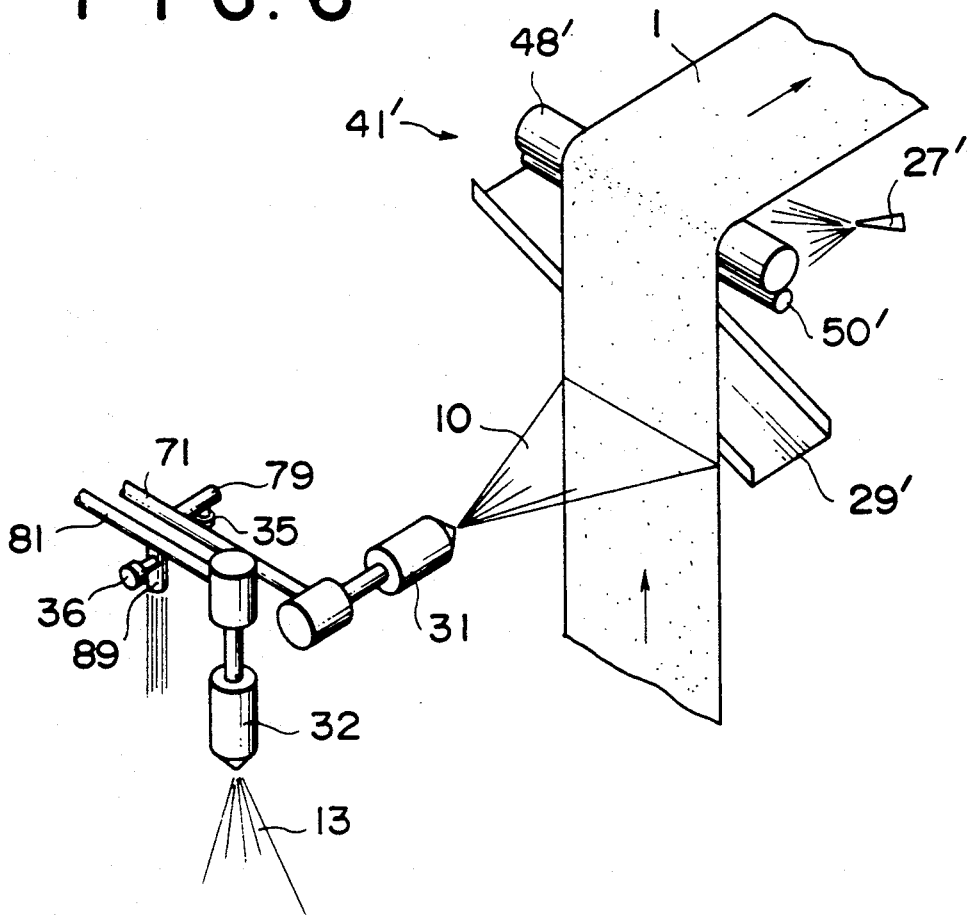
FIG. 6 is a perspective view showing another embodiment of operation of cleaning for a guide locates near a place where spray dyeing is carried out.

As the first means for cleaning the guides 41, 42, a means, which is similar to the above mentioned second means, can be used. For example, as shown in FIG. 6, a roll 48' itself serves as a guide 41' and a drain roll 50' is placed in pressure to be contacted with the roll 48'. Further a receiving gutter 29' is placed under the rolls 48', 50'. Then, each cleaning-solution 13, 12 is sprayed for the tape 1 from a cleaning-nozzle 27'.

Hot water of 100° C. is preferably used as the cleaning-solution 12, 13 in order to keep conditions of an atmosphere in the colouring chamber 4.

In this embodiment, cleaning for the guides 41, 42, 43, 44 is carried out with the cleaning-solution 12, 13. However, other suitable solutions can be used as the cleaning-solution.

While preferred embodiments have been described, it is apparent that the present invention is not limited to the specific embodiments thereof.

What is claimed is:

1. A method of continuous changing dye-color during spray dyeing of a long tape, which is to be dyed, said method comprising:

continuously moving the tape over guides;

spraying a first dye-solution on said moving tape from a first dyeing-nozzle connected to a first feeding line to form a first portion of the tape with a color of the first dye-solution;

stopping said spraying with said first dye-solution to create a dwell;

exchanging said first dyeing-nozzle with a second dyeing-nozzle, which is connected to a second feeding line with a second dye-solution, during said dwell;

then spraying the second dyeing-solution on the tape from the second dyeing-nozzle to form a second portion of the tape with a second color of the second dye-solution separated by an undyed portion that was created during the dwell;

cleaning said first dyeing-nozzle and said first feeding line with a first cleaning-solution, which is fed through said first feeding line, while said second dye-solution is being sprayed on said tape; and cleaning each of the guides as the undyed portion passes over the respective guide.

2. A method according to claim 1, wherein said step of exchanging of said dye-nozzles is carried out by turning the first dyeing-nozzle away from said tape and turning the second dyeing-nozzle toward said tape.

3. A method according to claim 1, wherein said guides are cleaned with a cleaning-solution from cleaning-nozzles, which are connected to said feeding lines.

* * * * *